US005423204A

United States Patent [19]

Shima et al.

[11] Patent Number: 5,423,204

[45] Date of Patent: Jun. 13, 1995

[54] TRANSFERRING JACK OF A FLAT KNITTING MACHINE

[75] Inventors: Masahiro Shima; Takekazu Shibuta, both of Wakayama, Japan

[73] Assignee: Shima Seiki Mfg., Ltd., Wakayama, Japan

[21] Appl. No.: 166,994

[22] Filed: Dec. 16, 1993

[30] Foreign Application Priority Data

Dec. 17, 1992 [JP] Japan ..... 4-337328

[51] Int. Cl.[6] ..... D04B 7/00

[52] U.S. Cl. ..... 66/109; 66/96 R

[58] Field of Search ..... 66/95, 96 R, 109, 64

[56] References Cited

U.S. PATENT DOCUMENTS

| | | | |
|---|---|---|---|
| 2,401,732 | 6/1946 | Hayhurst | 66/96 R |
| 2,708,355 | 5/1955 | Piltz | 66/96 R |
| 3,315,495 | 4/1967 | Kühnert | 66/96 R |
| 3,385,083 | 5/1968 | Erb | 66/96 R X |

FOREIGN PATENT DOCUMENTS

| | | | |
|---|---|---|---|
| 373863 | 4/1923 | Germany | 66/96 R |
| 591171 | 12/1933 | Germany | 66/96 R |
| 584208 | 10/1958 | Italy | 66/96 X |
| 0950824 | 8/1982 | U.S.S.R. | 66/96 R |

*Primary Examiner*—John J. Calvert

*Attorney, Agent, or Firm*—Armstrong, Westerman, Hattori, McLeland & Naughton

[57] ABSTRACT

A transferring jack for a flat knitting machine for entering the stitch expanded portion of a stitch to be transferred to allow the distal end of the knitting needle to which the stitch is to be transferred to enter such stitch, such transferring jack having a distal end from a stitch engaging portion, a stitch transferring aperture formed with an elastic plate at the stitch engaging portion and a guide face formed by outwardly bending the elastic outwardly at a bottom edge of the jack transferring aperture for guiding the knitting needle to enter the stitch transferring aperture.

1 Claim, 17 Drawing Sheets

TRANSFERRING JACK OF A FLAT KNITTING MACHINE

BACKGROUND OF THE INVENTION

1. Field of the Invention

The present invention relates to an improvement of a transferring jack of a flat knitting machine.

2. Description of the Related Art

In a usual flat knitting machine, a pair of needle beds which contain movable knitting needles are arranged to form an inverted V-shaped form in a side view. In knitting a rib knit fabric by using front and rear knitting needles of this flat knitting machine, it is impossible to decrease stitches at an intermediate portion in a row of stitches.

To solve this problem, Japanese Examined Patent Publication No. 41-7907 discloses a flat knitting machine, wherein a pair of needles beds, containing movable knitting needles, are arranged to form an inverted V-shaped form in a side view. A transferring jack bed, containing movable jacks in jack grooves, is provided above each needle bed. A stitch to be transferred is transferred from the knitting needle to the transferring jack, and the stitch engaged with the transferring jack is transferred to another knitting needle after the transferring jack engaged with the stitch is moved in a transverse direction.

Further, Japanese Unexamined Patent Publication No. 1-168943 discloses a flat knitting machine, wherein a transferring jack bed is supported above a needle bed by supporting members. Transferring jacks, at the front ends of which stitch engaging portions are formed, are movably arranged in the transferring bed. The transferring jacks are moved forward and backward by a transferring cam accompanied with a carriage. The transferring jack bed is moved in a transverse direction by a driving means provided at one side of the transferring jack bed. A stitch engaged with the stitch engaging portion is moved in a transverse direction and the stitch is transferred to another knitting needle.

Furthermore, Japanese Examined Patent Publication No. 1-57173, of the present applicant, discloses a flat knitting machine, wherein what is called "four beds" is formed by arranging a pair of front and rear needle beds upward and downward. A stitch is transferred by moving knitting needles in each of the needle beds and the stitch can be transferred in a transverse direction by moving each of the needle beds in such transverse direction.

Furthermore, Japanese Examined Patent Publication No. 56-21854, of the present applicant, and Japanese Unexamined Patent Publication No. 63-256752 Discloses a flat knitting machine, wherein a transferring jack bed, containing movable jacks grooves, is provided above a needle bed. A stitch to be transferred is transferred from the knitting needle to the transferring jack. The stitch engaged with the transferring jack is transferred to another knitting needle after the transferring jack engaged with the stitch is moved in a transverse direction.

However, in most cases, stitch engaging portions of the transferring jacks of the flat (weft) knitting machine described in the above publications are formed with jack bodies and plate members of elastic material, which are disposed along one side of the jack bodies, and the stitch engaging portions elastically abut each other at the distal portions and are so arranged as to form stitch transferring apertures which allow the distal or tip portions of the knitting needles to enter in a plan view.

According to the above structure, there is a problem that the plate member is quite easily elastically deformed and the stitch transferring aperture is closed when same tension is acted on the stitch engaging portion. Consequently, the stitch cannot be successfully transferred because the knitting needle cannot enter the stitch transferring aperture.

Besides, where a stitch holding shoulder is formed at a base part of the stitch engaging portion, to stop the stitch engaged with stitch engaging portion of the transferring jack, there is a problem that the stitch engaging portion of the transferring jack is elastically deformed due to tension by the stitch engaged with it or a stitch cannot successfully be transferred because the shoulder interferes with a stitch expanding portion of the knitting needle, as the stitch expanding portion is elastically deformed, due to the tension of the stitch which was expanded by the stitch expanding portion.

SUMMARY OF THE INVENTION

The present invention avoids the above problems by ensuring that the distal part of the knitting needle enter through the stitch transferring aperture and that the stitch engaging portion of the transferring jack enter the stitch expanding portion of the knitting needle to allow the stitch to be transferred precisely.

To achieve the above, the present invention provides a transferring jack of a flat knitting machine having a knitting needle and a jack groove, comprising a jack body, a distal or tip end of the jack body forming a stitch engaging portion, the jack groove movably containing the transfer jack, a stitch transferring aperture formed at the stitch engaging portion, which allows the knitting needle to enter, at least one side of the stitch transferring aperture being formed, with an elastic plate, whereby the distal end is elastically closed and a guide face, formed at a bottom edge of the stitch transferring aperture, guides the knitting needle to enter the stitch transferring aperture.

At least one side of members forming the stitch engaging portion may be formed with an elastic plate, at a distal end of a jack body of the transferring jack, and the guide face, which guides the knitting needle, may be formed by bending outward the elastic plate at a lower part of the stitch engaging portion. The guide face, which guides the knitting needle, may be formed by machining elastic plate at a lower part of at least one of members of the stitch engaging portion at a distal end of the jack body.

Further, a transferring jack of a flat knitting machine of the present invention having a knitting needle with a stitch expanding portion for transferring a stitch formed at one side of a body of the knitting needle, and having a transfer jack, a distal end of which forms a stitch engaging portion with a pair of plate materials facing each other, is characterized by forming a guide portion formed at base part of at least one of said stitch engaging portions of a plate material of said transferring jack facing the stitch expanding portion, which guides the stitch.

As the carriage makes a round trip between a group of knitting needle for a predetermined width on the needle bed and knits a predetermined width, the carriage leads the needle selecting mechanism and operates a needle selecting portion of the transferring jack, to make a return trip between the edges of the predetermined width.

As the carriage returns, a specific butt of the transferring jack is movably operated by a stitch transferring cam and a transferring stitch is engaged with a stitch engaging portion at a distal end of the transfer jack.

Next, the stitch engaged with the stitch engaging portion is transferred to a specific knitting needle after the transfer bed moves in a transverse direction through a supporting member.

Even if a stitch transferring aperture is narrowed by a tension of a stitch engaged with a stitch engaging portion and is enhanced, due to the transverse movement of the transferring jack, when the distal end of the specific knitting needle is inserted into the stitch transferring aperture, the stitch can be successfully transferred because the distal end of the knitting needle is guided to the stitch transferring aperture by the guide face.

Where a stitch engaging portion is formed with a pair of plates facing each other, at the distal end of the jack body of the transferring jack, and a guide portion, for guiding a stitch is formed at a base part of the stitch engaging portion of the plate, facing the stitch expanding portion, out of the pair of the plates forming the stitch engaging portion, even if the transferring jack is elastically deformed by a tension of the stitch engaged with the stitch engaging portion, or the stitch expanding portion is elastically deformed by a tension of the stitch expanded here, or shifted a little, the stitch engaging portion will smoothly enter the stitch expanding portion to result in a successful stitch transferring.

BRIEF DESCRIPTION OF THE DRAWINGS

FIGS. 17A through 14D are side view of the relationship between positions of the knitting needle and the transferring jack in each position in FIGS. 16A through 16B;

DESCRIPTION OF THE PREFERRED EMBODIMENTS

First, an embodiment of the present invention is described.

Figure 1:
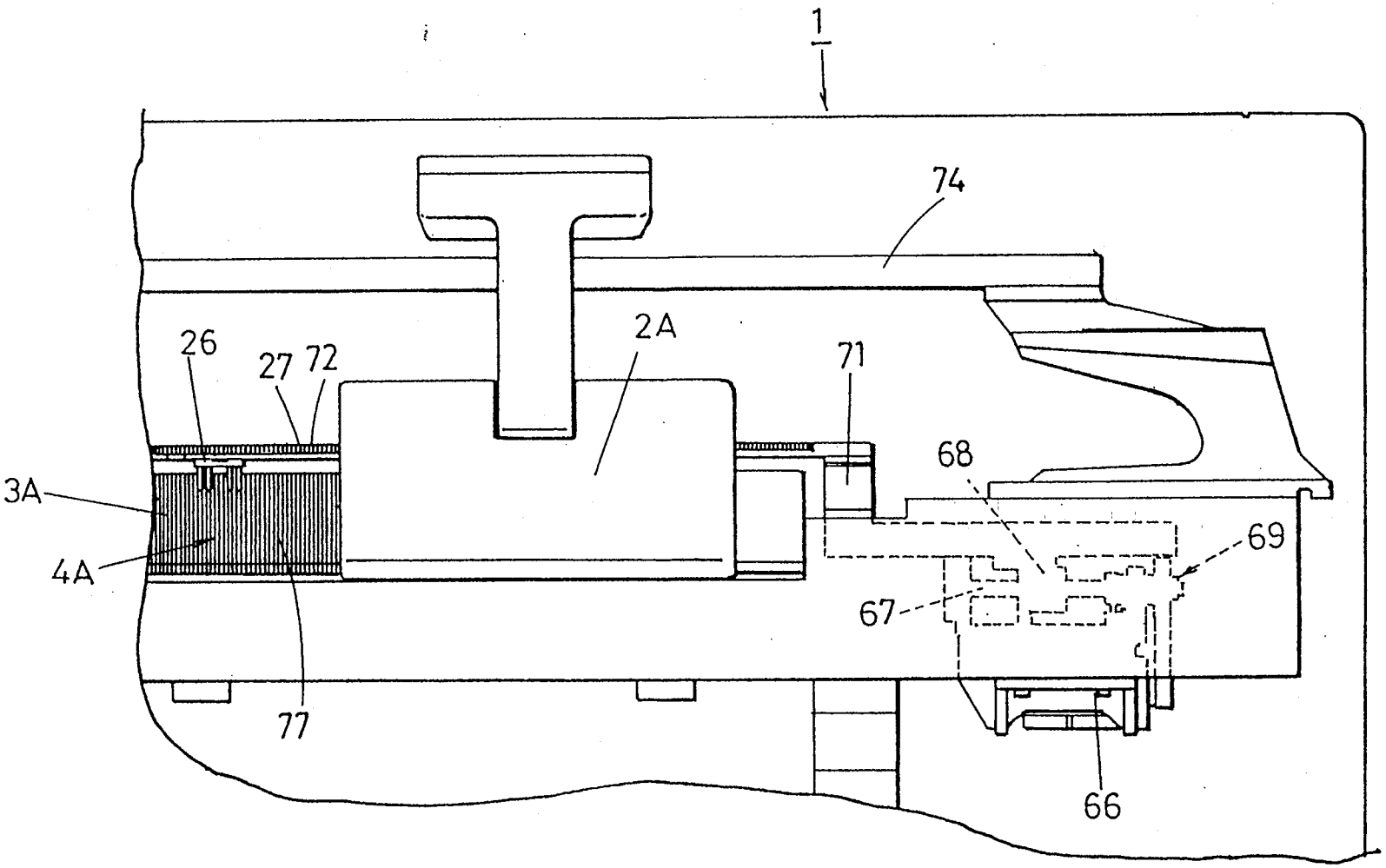
FIG. 1 is a schematic partly cross sectional elevational view of a flat knitting machine of the present invention.
Figure 2:
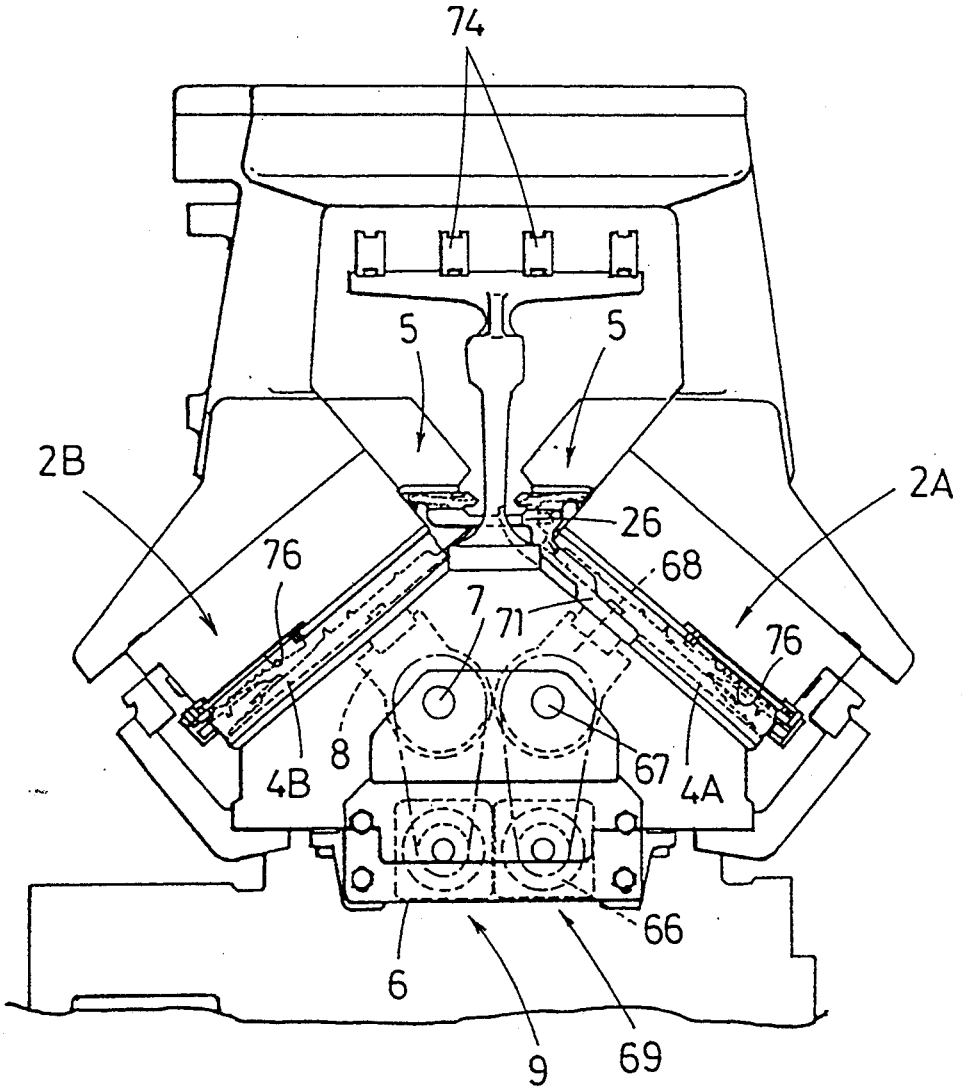
FIG. 2 is a schematic partly cross sectional side view of a flat knitting machine of the present invention.

FIG. 1 is a schematic elevational view of a first embodiment of a flat knitting machine having a transferring mechanism. FIG. 2 is a side view of FIGS. 1 and 3 is an enlarged cross-sectional side view of FIG. 2.

Figure 3:
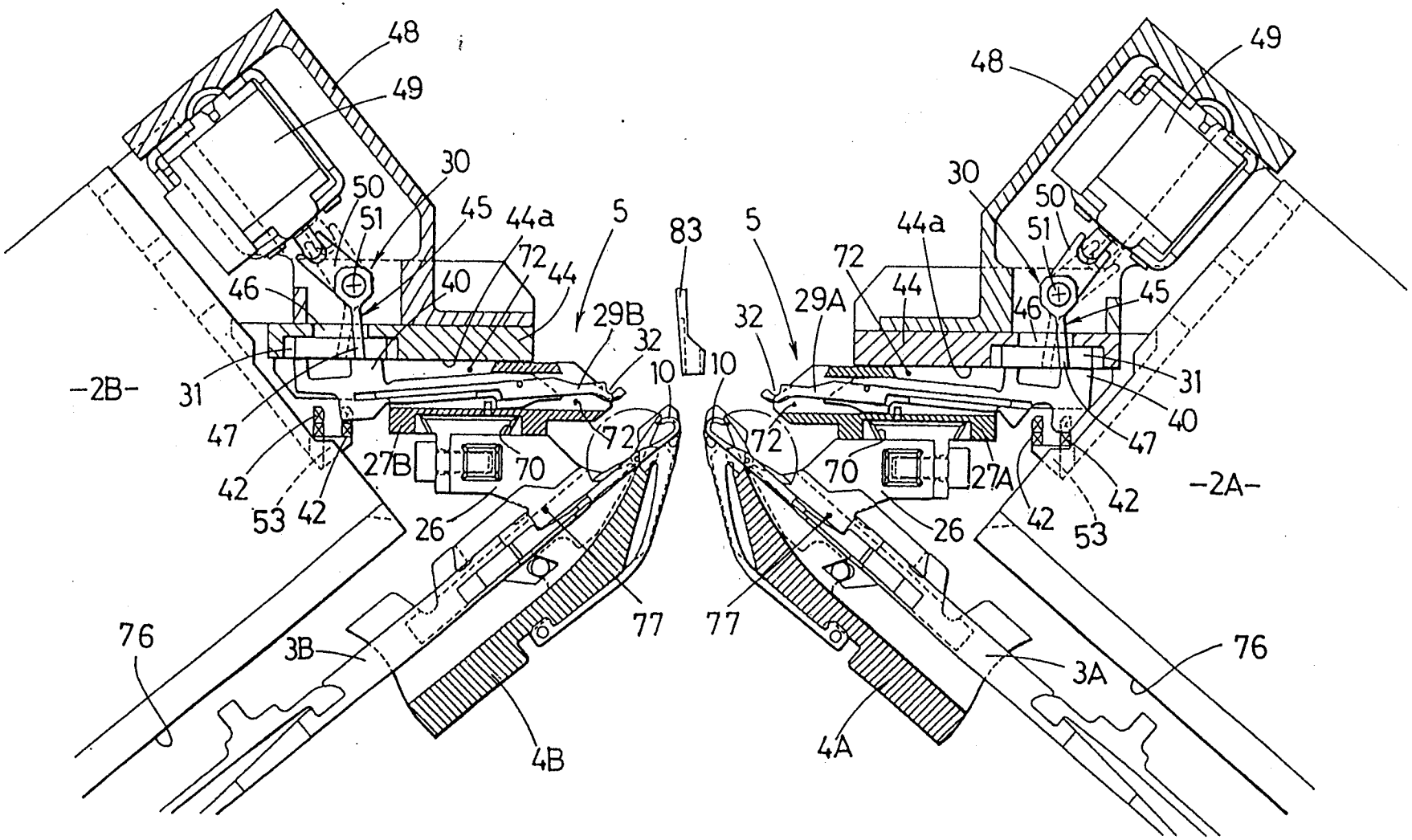
FIG. 3 is a schematic enlarged cross sectional side view of the principal part of the flat knitting machine of the present invention.

Referring to FIGS. 1 through 3, reference numeral 1 designated the flat knitting machine. The knitting machine 1 comprises a flat front lower needle bed 4A and a flat rear lower needle bed 4B which are arranged facing each other to form an inversed V-shaped form in a side view, and each transferring mechansim 5 arranged above each needle bed 4A, 4B respectively. In each of the needle beds 4A, 4B, a number of knitting needles 3A, 3B, FIG. 3 are arranged, respectively, so as to be movable in needle grooves 77 by carriage 2A, 2B. The rear needle bed 4B is movable in transverse direction by a driving means which comprises a motor 6, a driving screw shaft 7, a slider 8, and the like (see FIG. 2).

Figure 4:
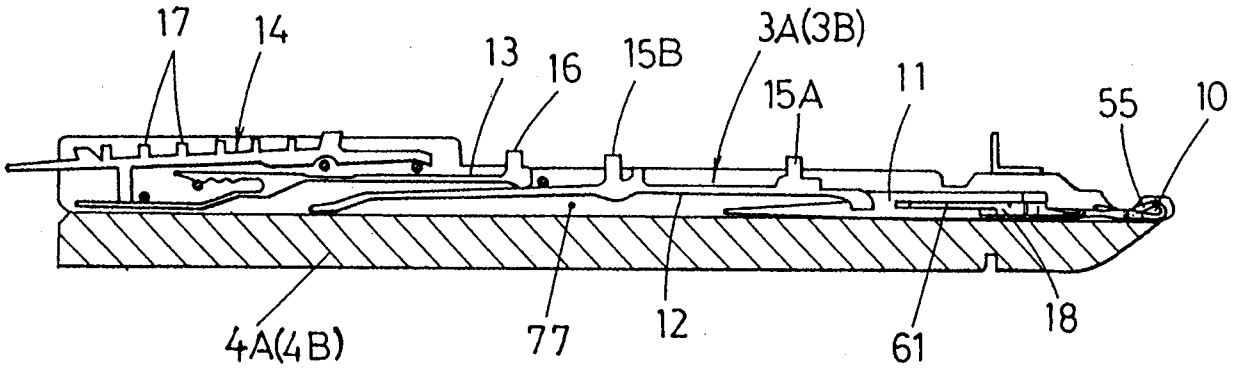
FIG. 4 is a side view of the portion involving the knitting needle of a flat knitting machine of the present invention.

Referring to FIG. 4, knitting needle 3A or 3B arranged in the needle groove 77 of the needle bed 4A or 4B comprises a knitting needle body 11 at the end of which a hook 10 is formed, a jack 12 which is connected to the rear end portion of the knitting needle body 11, a selecting jack 13 arranged at the rear portion of the jack 12, and a selector 14 arranged on the selecting jack 13. Butts 15A and 15B are projected upwardly from the jack 12, butt 16 is projected upwardly from the selector 14. When butts 15A, 15B, 16, and 17 move along a cam surface 76 of the carriage 2A, 2B, the jack 12, the selecting jack 13, and the selector 14 move in the needle groove 77.

An expanding member 18 for expanding a loop retained by the knitting needle 3A or 3B and elasticity allowing portion and a spring portion 61 are arranged at a one side of the knitting needles body 11. The expanding member 18 is formed by bending sheet metal into a boat like shape, in plan view and the end of the expanding member 18 is fixed to the one side of the knitting needle body 11.

Figure 5:
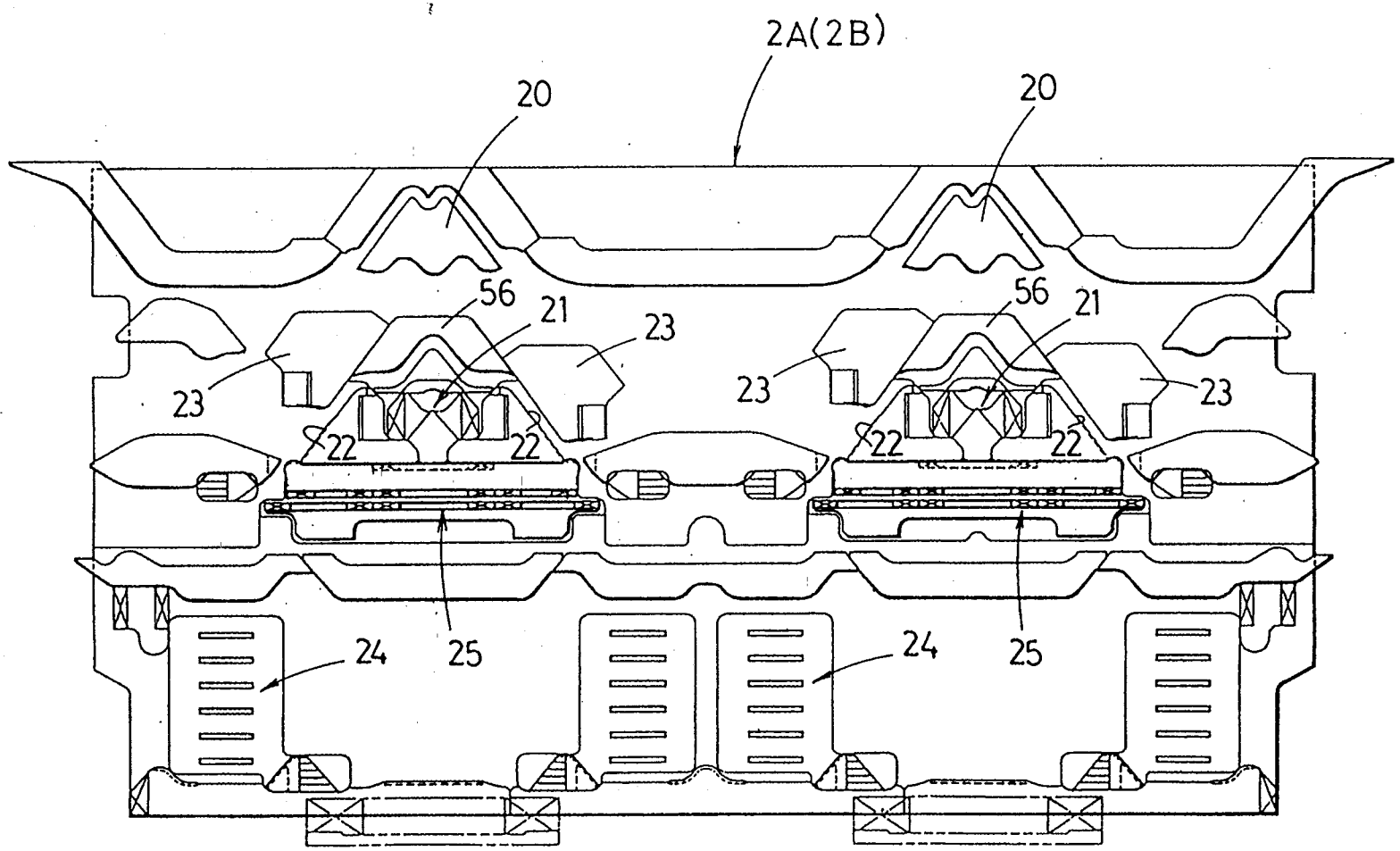
FIG. 5 is a schematic elevational view of the group of cams of the carriage of a flat knitting machine of the present invention.

Referring to FIG. 5, group of cams of the carriage 2A and 2B over the needles beds 4A and 4B comprises two cams units arranged side by side. The cam unit comprises a transferring raising cam 20 protruded and retracted by a solenoid or a motor (not shown), a substantially trapezoid transferring receiving cam 21 arranged under the transferring raising cam 20, and can be protruded and retracted, needle raising cams 22 formed at the sides of the transferring receiving cams 21, and a convex portion 23 at the side of the needle raising cams 22. Under the group of cams, a needle selecting actuator 24 which acts on butts 17 of the selector 14 of the knitting needles 3A and 3B is arranged. Between the needle selecting actuator 24 and the group of cams, a pressor mechanism 25 which acts the butt 16 of the selecting jack 13 of the knitting needles 3A and 3B so that the knitting needles 3A and 3B are located at the position for knitting, tucking, missing and transferring.

Each transferring mechanism 5, arranged between carriage 2A and 2B, is supported by each of the first transferring jack beds 27A, 27B (see FIGS. 1 and 3). Each of the transferring jack beds 27A, 27B is supported by each supporting member 26 which is provided at each of the needle beds 4A, 4B via each slide mechanism 70. The transferring jack beds 27A and 27B are connected to each other at the end portions thereof by moving control bracket 71. Control bracket 71 is driven by a driving means 69 which comprises a motor 66, driving screw shaft 67, slider 68, and the like.

By the needle beds 4A, 4B and the transferring mechansim 5, a stitch engaged with the knitting needle 3A on the front needle bed 4A can be transferred to the knitting needle 3B on the rear needle bed 4B or to a transferring jack 29A or 29B (referred to hereinafter) on the transferring jack bed 27A or 27B of the transferring mechanism 5. Also a stitch engaged with the knitting needle 3B on the rear needle bed 4B can be transferred to the knitting needle 3A on the front needle bed 4A or to the transferring jack 29A or 29B on the transferring jack bed 27A or 27B of the transferring mechanism 5.

In the transferring jack bed 27A and 27B, jack grooves 72 in which the transferring jack 29A and 29B are movably positioned are formed. On each transferring jack bed 27A or 27B, each transferring cam 31 and each needle selecting mechanism 30 for selecting the transferring jacks 29A and 29B are positioned.

Referring to FIGS. 6 through 9, a hook shaped stitch engaging portion 32 is formed at the front end of the transferring jack 29A (28B), a needle selected member 33 is formed at the rear end of the transferring jack 29A (29B), and a curved portion 79 is formed at the jack body 34 side of the stitch engaging portion 32.

Figure 10:
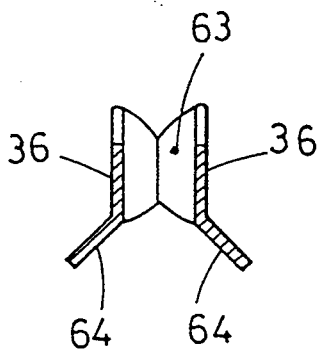
FIG. 10 is A—A sectional view of the transferring jack in FIG. 6.

In the stitch engaging portion 32, a pair of plate materials 36 of narrow width of spring steel facing each other project, the middle parts of which are caulked 62 with the jack bodies 34 from the both right and left sides of the jack bodies 34. In a plan view, the distal portions of both of the plate materials 36 are bent inward to about each other and form a stitch transferring aperture 63. In a side view, the distal portion forms a hook. A lower edge of the plate material 36 is bent outward, at a part of the stitch transferring aperture 63, and a guide face (guide part) 64 is formed inside, as shown in FIG. 10.

Figure 9:
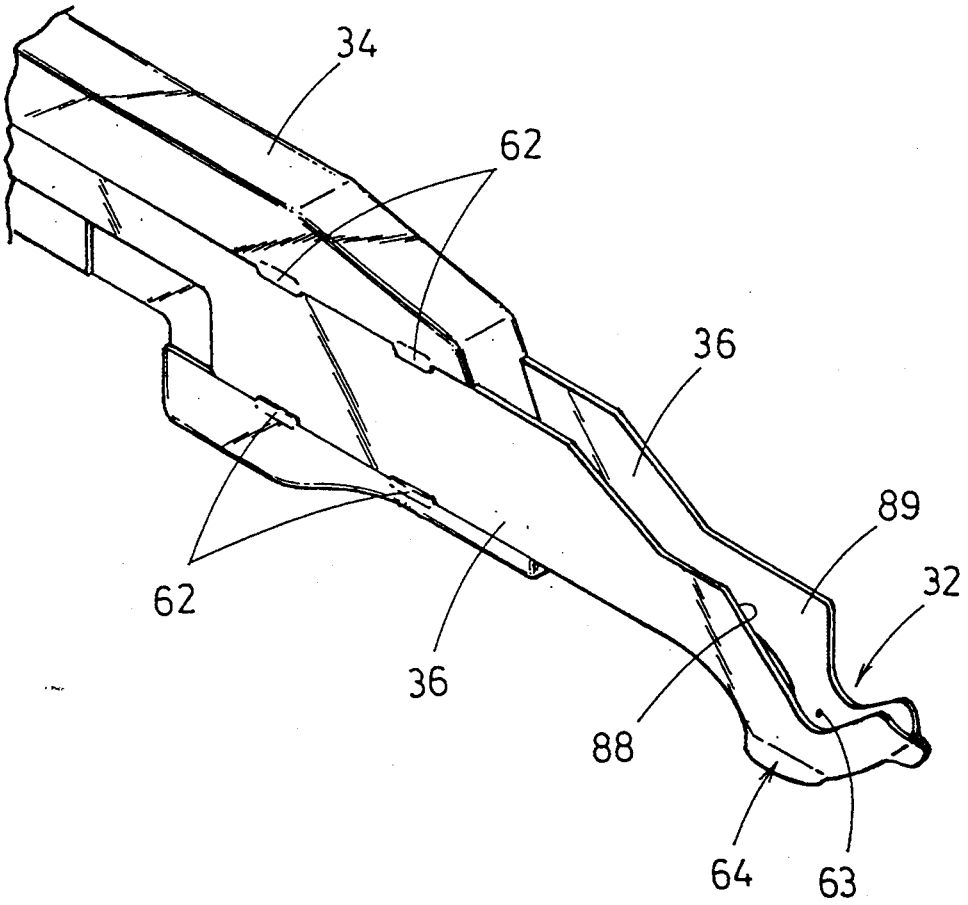
FIG. 9 is a perspective partly cross sectional view of the transferring jack of a flat knitting machine of the present invention.

Among a pair of above mentioned plate materials 36, forming the stitch engaging portion 32, the stitch engaging portion 32 of the plate material 36, facing the stitch expanding portion 18, is formed as a smoothly curved slope 88 at the base portion of the stitch engaging portion 32 with a shoulder part 89 to stop a stitch 52 at the base part of the stitch engaging portion 32 of the plate material 36 facing the knitting needle body 11 (see FIG. 9).

Figure 11:
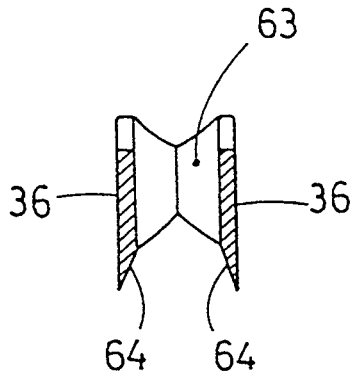
FIG. 11 is a sectional view of other example of the guide face corresponding to FIG. 10.
Figure 12:
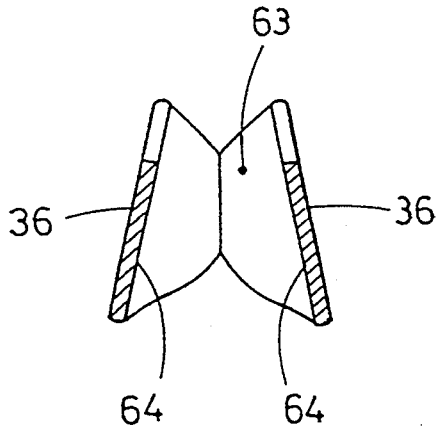
FIG. 12 is a sectional view of other example of the guide face corresponding to FIG. 10.

The guide face 64 can be formed by machining, as shown in FIG. 11, or can be formed by making the plate materials 36 broaded at a lower part, as shown in FIG. 12. Further, a base end side part of the plate material 36, facing a side of the jack body 34, is bent to form an elastic portion 37.

Figure 6:
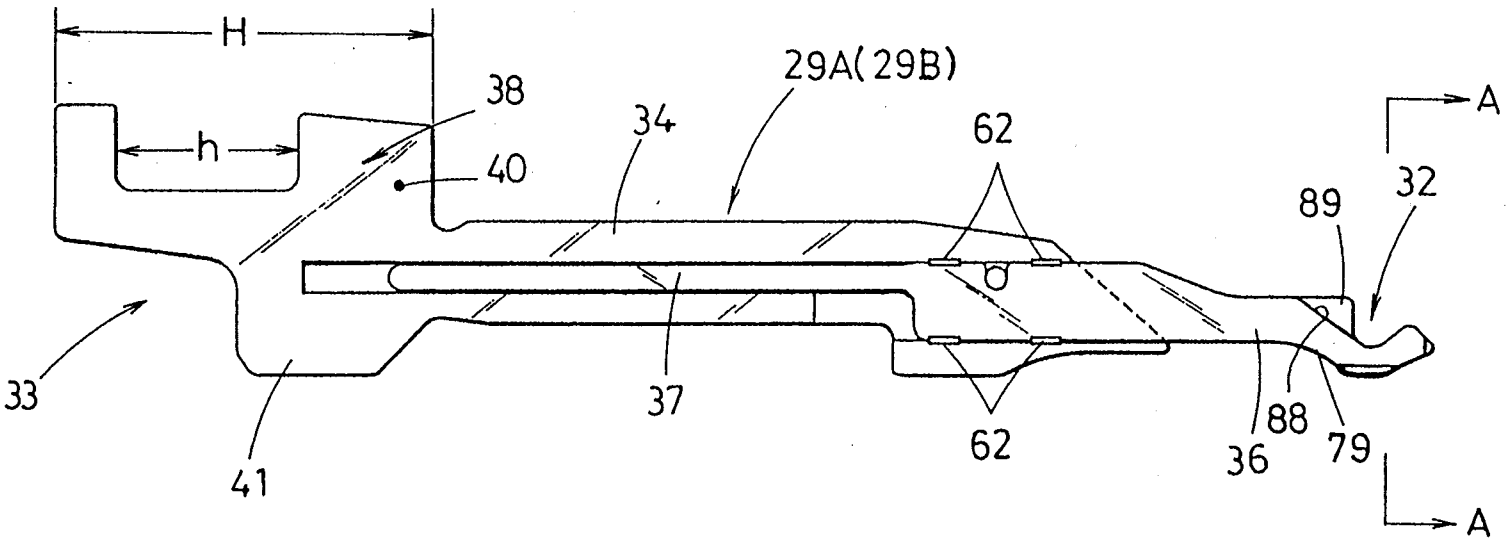
FIG. 6 is a side view of the transferring jack of a flat knitting machine of the present invention.
Figure 7:
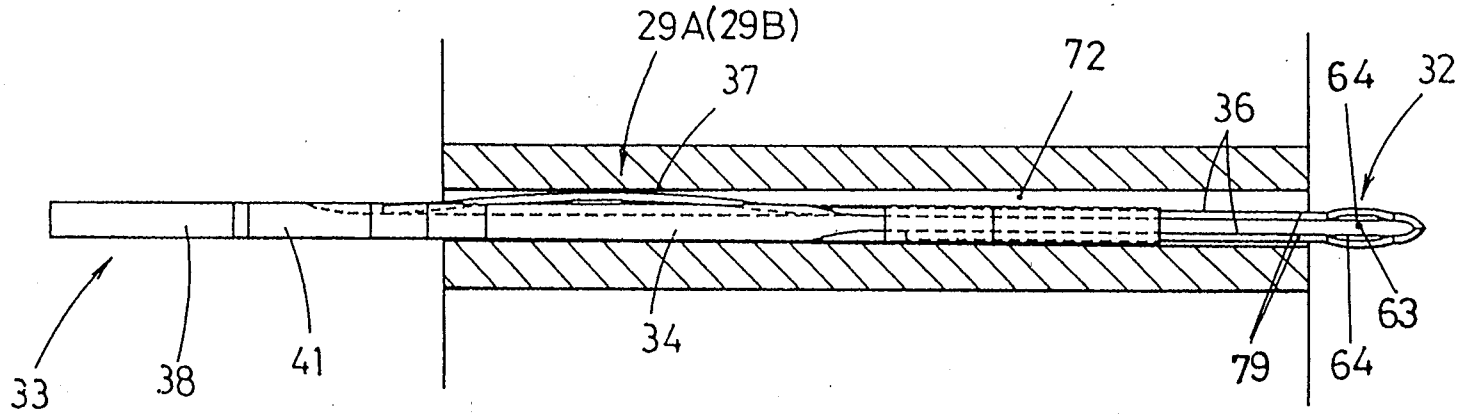
FIG. 7 is a bottom plan view of the transferring jack of a flat knitting machine of the present invention.
Figure 8:
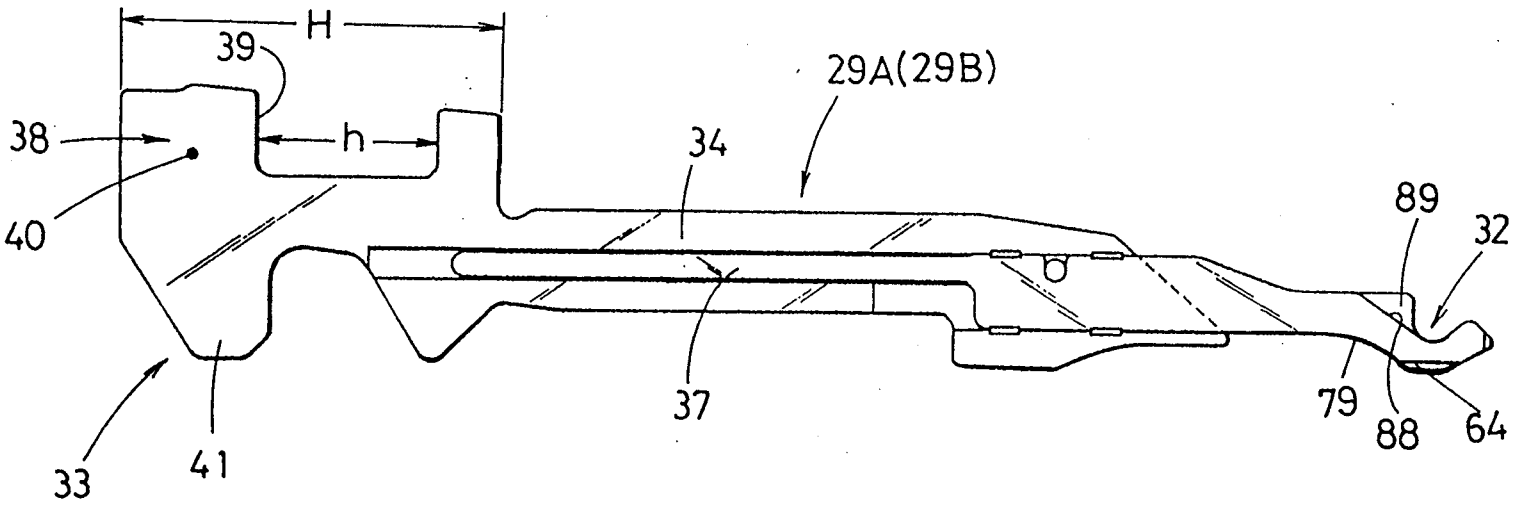
FIG. 8 is a side view of the transferring jack of a flat knitting machine of the present invention.

The needle selected member 33 comprises a plate 38 with a length H, and a return butt 41 with which a return cam 42 (referred to hereinafter) acts. At the plate 38, a groove, with a width h, is formed and forms a needle selected butt 40. The position of the needle selected butt 40 in FIG. 6 is different from needle selected butt 40' in FIG. 8, that is, the needle selected butts 40 In FIG. 6 and the needle selected butt 40 in FIG. 8 have different phases. According to this difference, the position of the return butt 41 in FIG. 6 is also different from the return butt 41' in FIG. 8. Transferring jack groups are formed from a plurality of transferring jacks 29A (28B) having the same needle selected members 33 transferring jack groups of different selected members 33, 33' are arranged, alternatively, every 1 inch.

Referring to FIG. 3, the transferring cam 31 for acting the needle selected butt 40, 40' of the needle selected member 33, 33' as the case maybe and the return cam 42 for acting the return butt 41, 41' are arranged at the space between the carriage 2A (2B) on the needle bed 4A (4B) and a yarn guide arranged over an aperture between the needle beds 4A and 4B.

Figure 13:
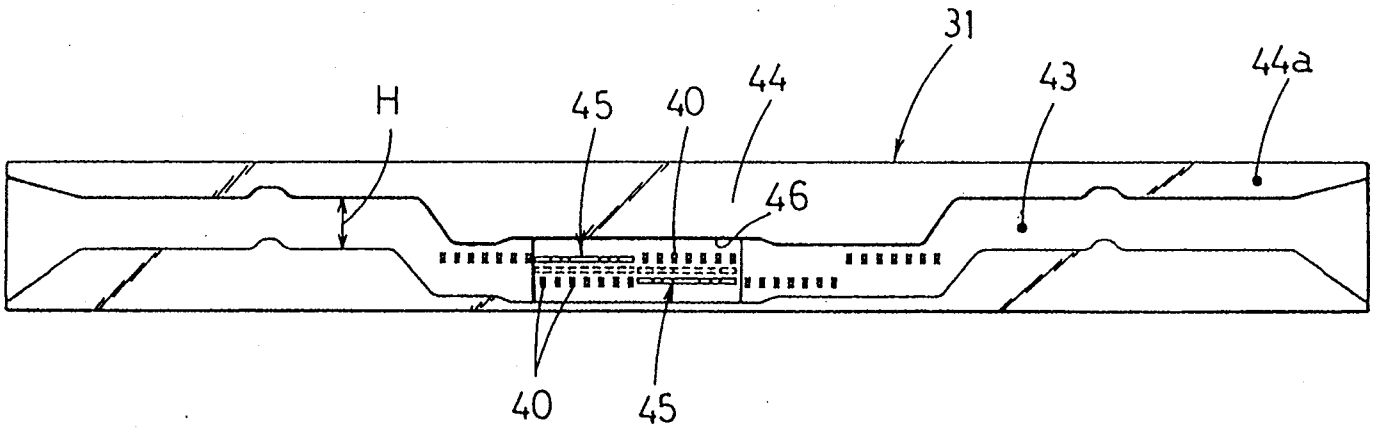
FIG. 13 is an elevational view of the transferring cam.

Referring to FIG. 13, the transferring cam 31 has a cam plate 44. A cam groove 43 with a width H is formed on the lower surface **44*a* of the camp plate 44 and the cam plate 44 protruded from the side portion of the carriage 2A (2B) so that the lower surface 44*a* of the cam plate 44 is slidable on the upper surface of the transferring jack bed 27A (27B). The return cam 42 for acting the return butt 47, 41' is fixed to a bracket 55 which is fixed to the side portion of the carriage 2A (2B). At the center of the cam groove 43 of the cam plate 44, operation holes through which operating portion of an actuator 45 of a needle selecting means 30 for operating the needle selected butt 40** is provided.

Figure 14:
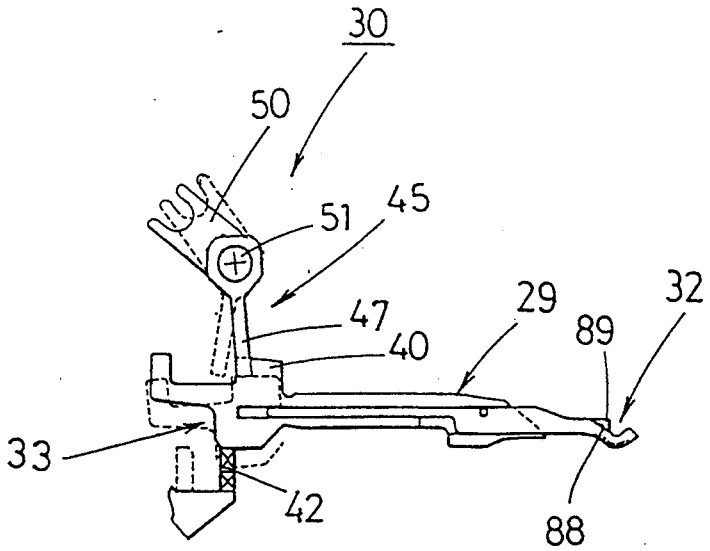
FIG. 14 is a side view of the principal part illustrating the action of the transferring jack.

Referring to FIG. 3, needle selecting means 30 comprises a solenoid 49, a swinging lever 50, supporting axis 51, and a needle selecting cam plate. The solenoid 49 is fixed to casing 48 which is fixed to the carriage 2A (2B). The solenoid 49 is connected to the one each of the swinging lever 50 and the other end thereof is fixed to the supporting axis 51. The needle selecting cam plate 47 which passes through the operation hole 46 and operates as the operating portion of the actuator 45 is also fixed to the supporting axis 51. Different needle selecting means 30 are arranged in transferring jack bed **27*a* or 27*b*, respectively, corresponding to the transferring jacks 29A (29B) (see FIGS. 14 and 15**).

The operation of the transfer jack 29A, 29B of the flat knitting machine will be explained as follows:

When the carriage 2A (2B) moves reciprocally on the needle bed 2A (2B), because each butt 15A, 15B, or 16 of the knitting needle 3A or 3B is operated by the cam surface 76 of the carriage 2A or 2B, the knitting needle 3A or 3B is moved reciprocally in the needle groove 77 and, thus, knitted goods are knitted by feeding yarn from a yarn feeder 61.

With usual knitting, the solenoid 49 of the needle selecting means 30 of the transferring mechanism 5 maintains the swinging lever 47 in a standing position and therefore the needle selected butt 40 which is in a waiting position is pushed downwardly not to by operated by the cam groove 43 of the cam plate 44 even though the carriage 2A (2B) moves. The needle selected butt 40 which is pushed downwardly in an unoperated position is returned to the waiting position again by the return cam 42.

Accordingly, when the carriage 2A (2B) passes the edge portion of the knitting goods, because the needle selecting means 30 of the transferring mechanism 5 exists outside of the transferring jack 29A (29B) to be selected and the needle selected butt 40 of the transferring jacks 29A (29B) do not prevent the carriage 2A (2B) from moving even though the carriage 2A (B) is moved in an adverse direction.

The case in which stitch is reduced is explained as follows. For convenience, the case in which the stitch 52 engaged to the front knitting needle 3A is transferred to the ajoining front knitting needle 3A is explained referring to FIGS. 16 through 17.

FIGS. 17A~17D and FIGS. 19A~19D designate the group of cams of the carriage 2A for moving the knitting needles 3A on the front needle bed 4A, and the cam groove 43 on the cam plate 44 for operating the transferring jacks 29B in the rear transferring jack bed 27B. When the carriage 2A is moved on the needle bed 4A from right to left, the butts 15A and 15B of the jack 12 of the knitting needle 3 and the butt 16 of the selecting jack 13 of the knitting needle 3 pass in the group of cams of the carriage 2 from left to right as shown symbols A,B,C. amd D in FIG. 16.

Figure 16:
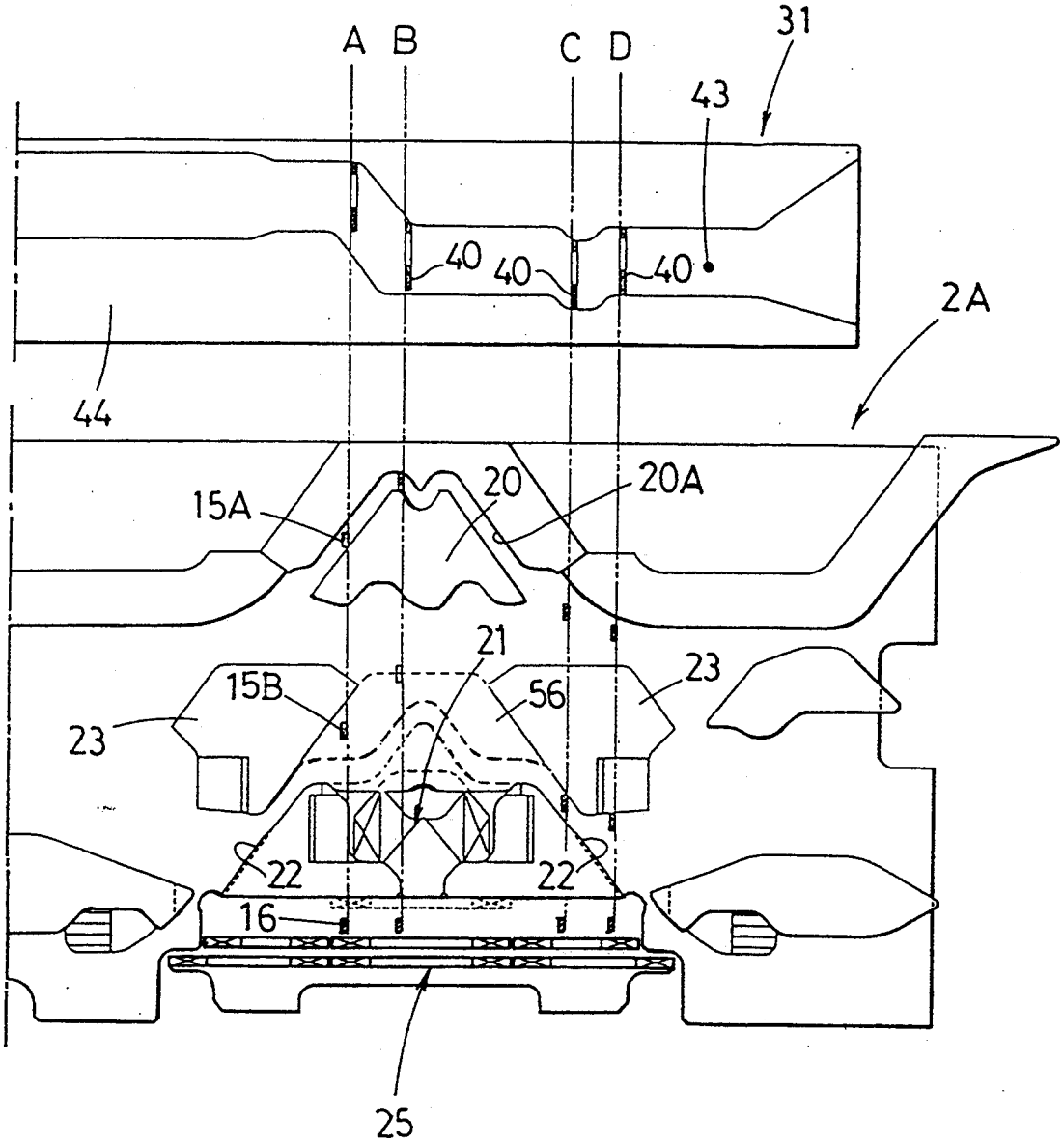
FIG. 16 is an elevational view illustrating the groups of the cams of the carriage and the relationship between positions of the cam groove of the transferring cam and the knitting needle.
Figure 17A:
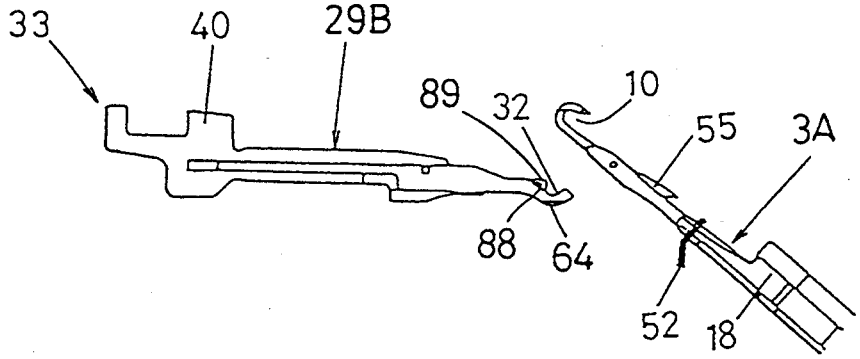

When the front knitting needle 3A reaches the positin A in FIG. 16, the butt 15A of the jack 12 is gradually pushed upwardly by the transferring raising cam 20 and thus the front knitting needle 3A is raised gradually. Therefore, as shown in FIG. 17a, the stitch 52 opens the latch 55 and the stitch 52 is also opened by a opening member 18.

Figure 17B:
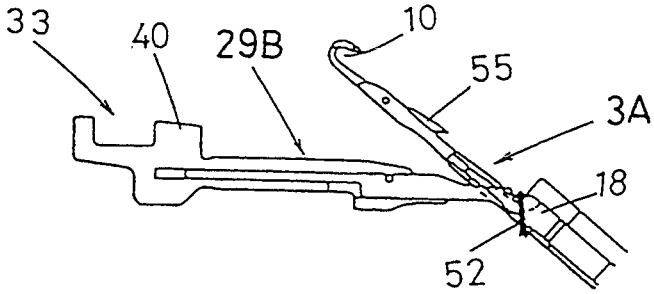

When the front knitting needle 3A reaches the position B, as shown in FIG. 17B, the front knitting needle 3A is projecting forward mostly and the needle selected butt 40 of the transferring jack 29B is pushed outwardly but the cam groove 43 of the cam plate 44 so to push the transferring jack 23B outwardly. The stitch engaging portion 32 is guided through the stitch 52 opened by the opening member 18 and then, the stitch engaging portion 32 receives the stitch 52.

At this time, even when the stitch expanding portion 18 of the knitting needle 3A is elastically deformed by a tension of a stitch 52 and expanded by the stitch expanding portion, the stitch engaging portion 32 of the transferring jack 29B is guided by the smooth slope 88 to smoothly enter the stitch expanding portion 18 of the knitting needle 3A without the shoulder part 9 being caught. Consequently the stitch 52 can be successfully transferred to the stitch engaging portion 32 at the distal end.

Figure 17C:
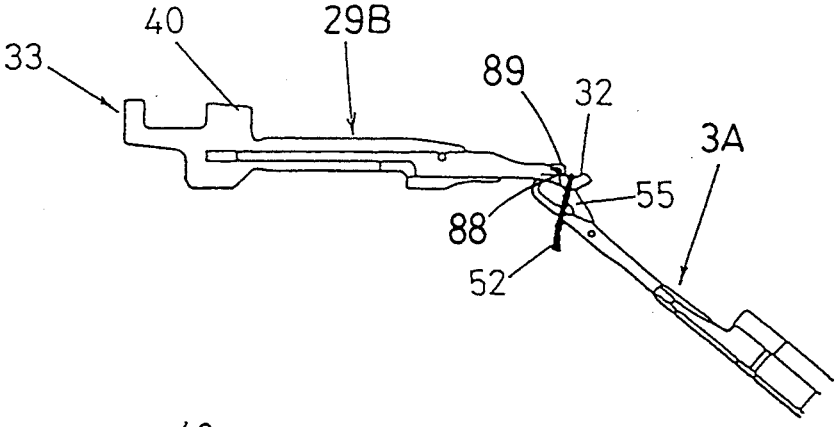

When the front knitting needle 3A reaches the position C, as shown in FIG. 17C, the front knitting needle 3A is retracted gradually because the butt 15A of the jack 12 is gradually pushed downwardly, and the needle selected butt 40 of the transferring jack 29B is pushed outwardly by the cam groove 43 of the cam plate 44 so that the stitch 52 does not interfere with the latch 55 when the front knitting needle 3A retracts.

Figure 17D:
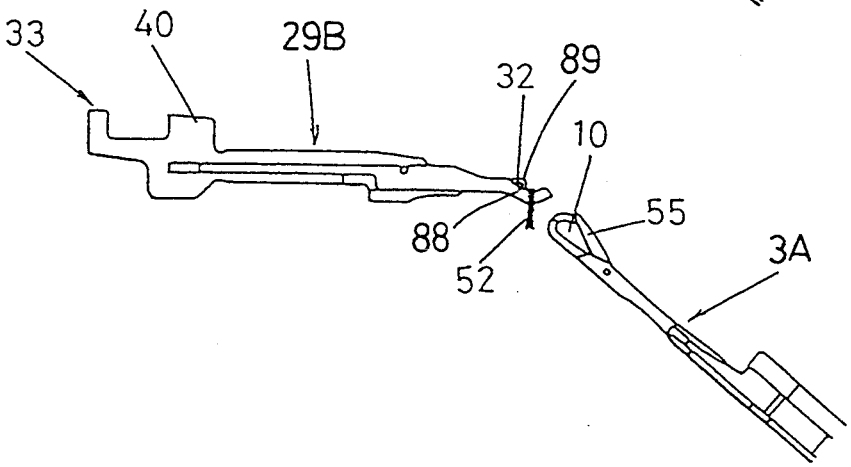

When the front knitting needle 3A reaches the position D, the butt 15B of the jack 12 passes the convex cam 23. As shown in FIG. 17D, the stitch 52 engaged with the front knitting needle 3A in FIG. 17A has been transferred from needle 3A to the stitch engaging portion 32 of the transferred from jack 29B.

When the group of cams of the carriage 2A passes the portion where the knitted goods is knitted, the transferring jack 29B keeps the stitch 52 at the stitch engaging portion 32.

Subsequently, the transferring jack bed 27B is moved transversely by predetermined pitches (for example one pitch) by the motor 66 via the driving screw shaft 67, the slider 68, and the move control bracket 71. At this time, because the curved portion 29, formed at the jack body 34 side of the stitch engaging portion 32, is positioned above the protruded member, like the sinker arranged at the aperture between the needle beds 4A and 4B, the transferring jack bed 27B can be moved transverse direction without interferring with the sinker or the knitting needles 3A and 3B.

Figure 15:
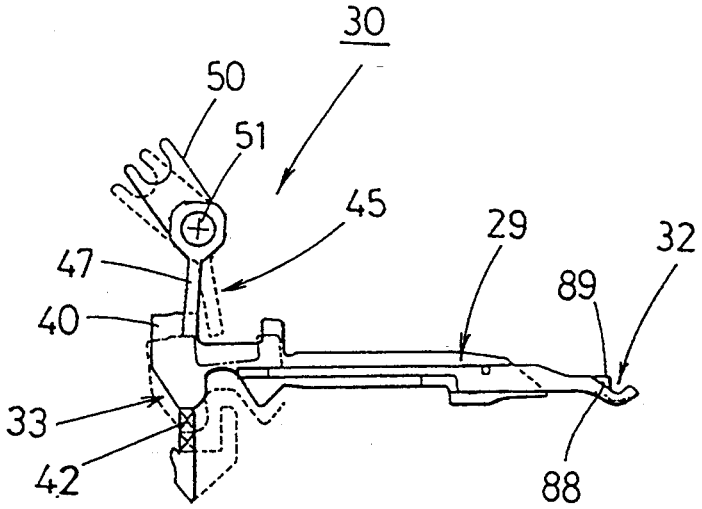
FIG. 15 is a side view of the principal part illustrating the action of the transferring jack.
Figure 18:
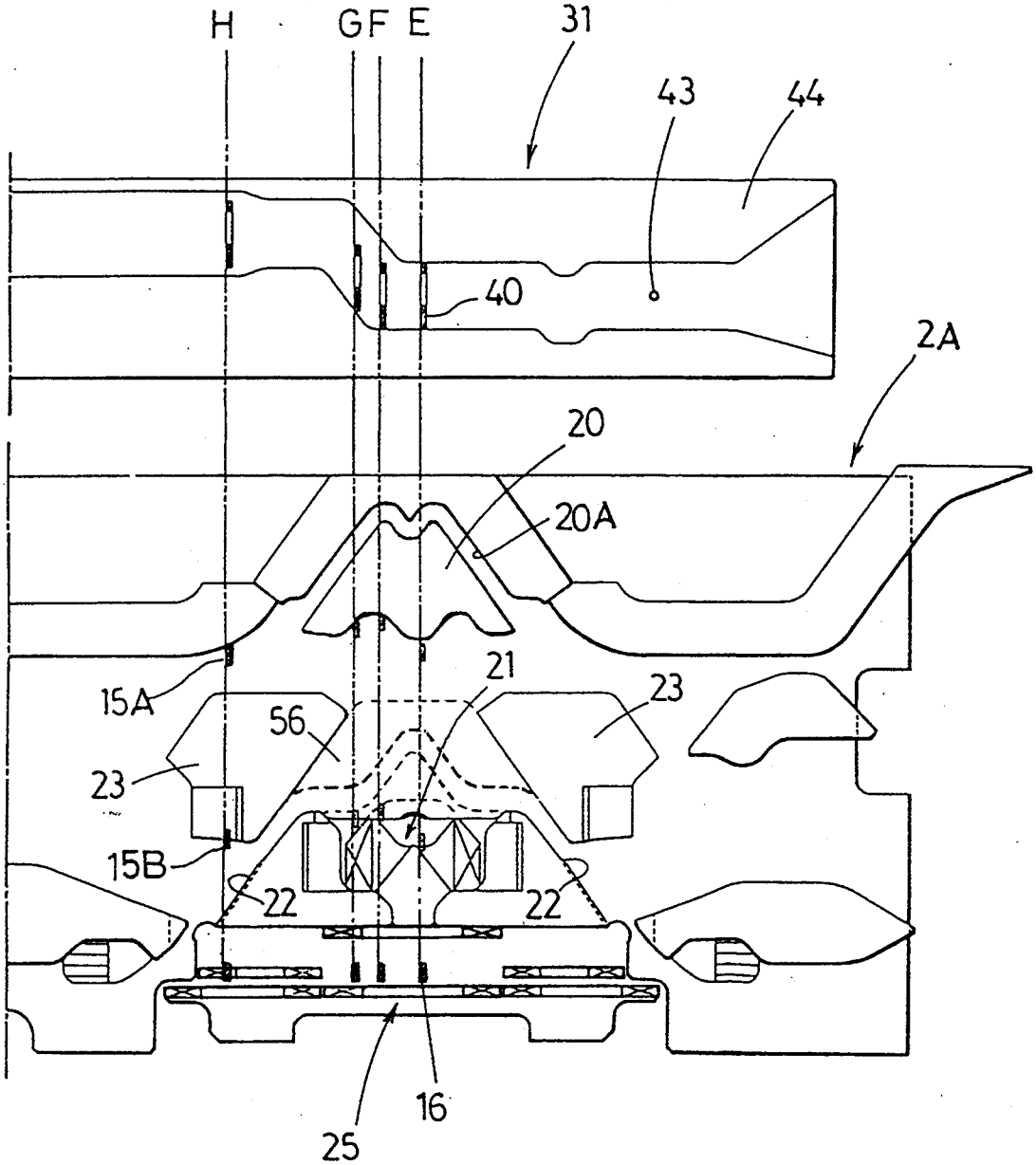
FIG. 18 is an elevational view illustrating the groups of the cams of the carriage and the relationship between positions of the cam groove of the transferring cam and the knitting needle.

Subsequently, when the carriage 2A (2B) is moved in an adverse direction along the needle bed 4A (4B), the butts 15A and 15B of the jack 12 of the knitting needle 3 and the butt 16 of the selecting jack 13 of the knitting needle 3, as shown in FIG. 18, pass in the group of cams of the carriage 2 from right to left as shown by symbols E, F, G, and H in FIG. 15.

Figure 19A:
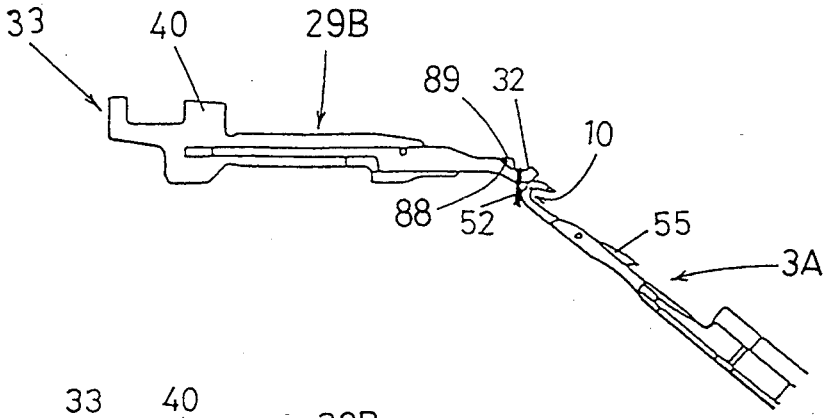
FIGS. 19A through 19D are side view of the relationship between positions of the knitting needle and the transferring jack in each position in FIGS. 18E through 18B.
Figure 19B:
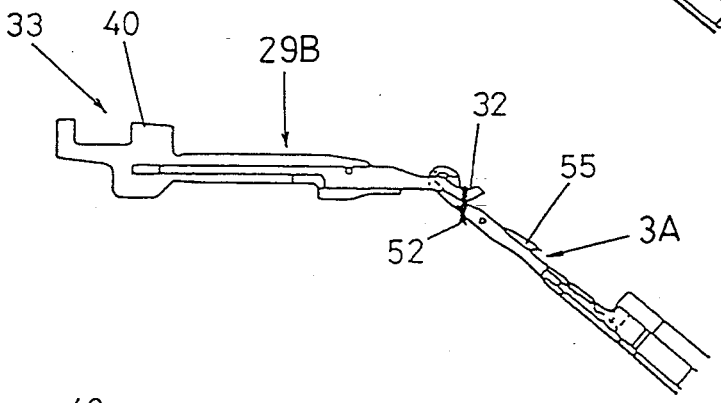

When the front knitting needle 3A, which receives the stitch 52, reaches from the position E to the position F, as shown in FIGS. 19A and 19B, the butt 15B of the jack 21 is operated by the transferring raising cam 20, the front knitting needle 3A is pushed outwardly, the hook 10 of the front knitting needle 3A is introduced into the needle selected member 32, and the stitch 52 is engaged with hook 10.

When the hook 10 of the transferred rear knitting needle 3B enters the stitch transferring aperture 63, the stitch 52, engaged with the stitch engaging portion 32, is about to be pushed toward the base end of the stitch engaging portion 32 by the hook 10 of the front knitting needle 3A, but the shoulder part 89 holds the stitch 52 and the hook 10 of the knitting needle 3B, entering the stitch transferring aperture 63 and remains inserted into the stitch 52.

Further, where the guide face 64 for the knitting needle is formed by bending a bottom edge of the plate material 36 corresponding to the stitch transferring aperture 63, as in this embodiment, the stitch engaging portion 32 is prevented from being deformed by tension of the stitch 52, as the transferring jack bed 27B is moving in a transverse direction, and the hook 10 of the knitting needle 3A, guided by the guide face 64, expands the stitch transferring aperture 63, even when the stitch transferring aperture 63 is narrowed, ensuring the knitting needle 3A to be insert into the stitch transferring aperture 63. Consequently stitch 52 can be successfully transferred.

Figure 19C:
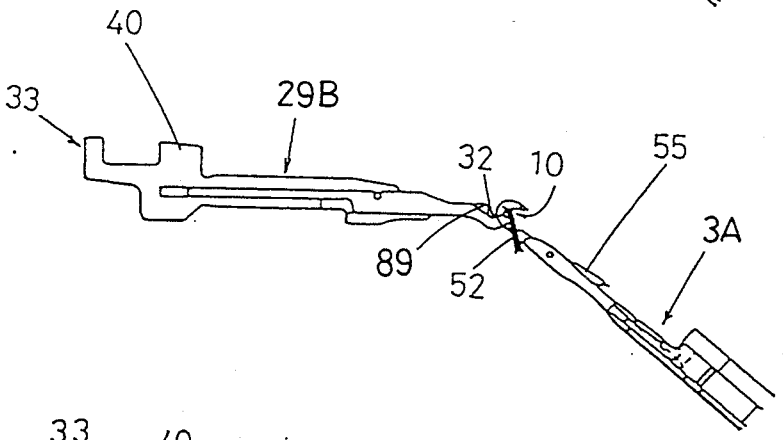

When the front knitting needle 3A reaches the position G in FIG. 18, the front knitting needle 3A is gradually retracted by the transferring raising cam 20, and the transferring jack 29B begins to retract because the needle selected butt 40 of the transferring jack 29B is operated by the cam groove 43 of the cam plate 44. Therefore, as shown in FIG. 19C, the stitch 52 engaged with the stitch engaging portion 32 transferred to the hook 10 of the front knitting needle 3A.

Figure 19D:
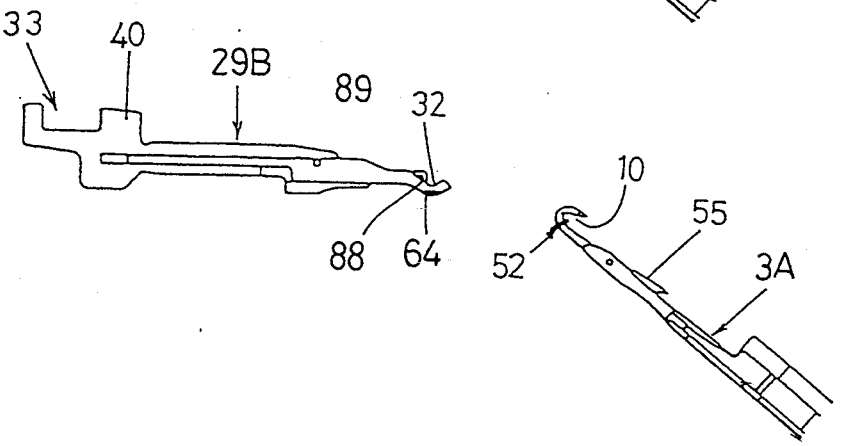

Subsequently, when the front knitting needle reaches the position H in FIG. 18, as shown in FIG. 19D, the transferring jack 29B is retracted further because the needle selected butt 40 of the transferring jack 29B is pushed inwardly by the cam groove 43 of the cam plate 44, the front knitting needle 3A received the stitch 52 is also retracted. As a result, the transfer of the stitch is completed.

In the above embodiment, the knitting needle is a latch needle but, needless to say, the present invention can also be practiced with a compound needle. Furthermore, the number of types of butt for needle selection, constituting the needle selecting part of the above embodiment, can be three or more for different phases against a sliding direction of a transfer jack.

In the above embodiment, the stitch transferring aperture is formed by two plate materials but, needless to say, one or both of said plate materials can be formed by the jack bodies.

Further, the above example is described in case that a stitch engaged with a rear knitting needle is transferred to a rear knitting needle. A stitch engaged with a front knitting needle can be transferred to a front knitting needle.

What is claimed is:

1. A transferring jack of a flat knitting machine having a knitting needle, comprising:

a jack body having a distal end forming a stitch engaging portion with a pair of plates facing each other, said knitting needle having a stitch expanding portion formed at one side of a body of said knitting needle for transferring a stitch; and said pair of plates of said jack body having a smoothly curved sloped guide portion formed at a base part of said stitch engaging portion and being positioned in said knitting machine to face said knitting needle, said stitch expanding portion of said knitting needle positioned for introduction into said stitch engaging portion of said plates without interference between said distal end of said jack body and said stitch expanding portion of said knitting needle.

* * * * *